United States Patent [19]

Salvatore

[11] Patent Number: 5,020,478

[45] Date of Patent: Jun. 4, 1991

[54] ANIMAL RESTRAINING DEVICE

[76] Inventor: Gene Salvatore, 912 S. Temple Blvd., Temple, Pa. 19560

[21] Appl. No.: 503,954

[22] Filed: Apr. 4, 1990

[51] Int. Cl.[5] ..... A61D 3/00

[52] U.S. Cl. ..... 119/98

[58] Field of Search ..... 119/19, 29, 98, 99, 119/151, 158

[56] References Cited

U.S. PATENT DOCUMENTS

| | | | |
|---|---|---|---|
| 608,632 | 8/1898 | Authier | 119/99 |
| 1,398,484 | 11/1921 | Holding | 119/98 |
| 2,536,943 | 1/1951 | Kessel | 119/1 |
| 4,228,765 | 10/1980 | Berlin | 119/98 |
| 4,269,149 | 5/1981 | Thomas | 119/99 X |

*Primary Examiner*—Robert P. Swiatek

*Attorney, Agent, or Firm*—Antonelli, Terry, Stout & Kraus

[57] ABSTRACT

An animal restraining device is provided which permits a human to safely attend to caring for an animal. To this end, a base is provided having a peripheral side wall which surrounds the animal. A cover having an opening for the animal'head is placed over the head of the animal, and is capable of movement relative to the base. By virtue of this movement, the animal is relatively comfortable and does not feel particularly restrained within the base. At the same time, the human is protected from injury from the lower or rear extremeties of the animal. The arrangement is particularly useful in orally administering medicine to the animal, or in treatment of problems in the animal's head region.

9 Claims, 2 Drawing Sheets

ANIMAL RESTRAINING DEVICE

FIELD OF THE INVENTION

The present invention relates generally to an animal restraining device, and more particularly to an animal restraining device which permits a human to attend to caring for the animal while being protected from injury by the lower or rear extremities of the animal.

BACKGROUND OF THE INVENTION

In caring for an animal, it is often required to administer to the head area of the animal. For example, medication often has to be administered orally. Also, ear care is sometimes required, for example, in removing parasites, tending to injuries or in removing matted hair from behind the ears. Similarly, care is occasionally required for the animal's eyes or nose.

In many cases, administering to the head area of an animal can be extremely difficult because animals often become quite disturbed during such treatment. This is especially true with regard to cats who will instinctively defend themselves with the claws of their rear legs in such situations. Thus, while a person is trying to cope with the difficulties of providing care to the animal by administering medicine orally or by attending to other treatment in the head area, the cat is inflicting considerable injury to the person by way of the claws of their rear legs. Accordingly, it is highly desirable to provide a simple, relatively inexpensive device to permit caring for the animal without being injured.

SUMMARY OF THE INVENTION

It is an object of the present invention to provide a device which will permit a person to attend to caring for an animal while being protected from injury by the animal.

It is a further object of the present invention to permit a person to be able to administer medicine or to attend to care around the head area of the animal while being protected from injury from the claws of the rear legs of the animal.

To achieve this and other objects, an animal restraint device is provided to permit a person to safely attend to caring for the animal. The device includes a base having a peripheral side wall for surrounding the animal. A cover is then provided with an opening for the animal's head. The cover L is placed over the animal's head, and is capable of movement relative to the base. Because the animal can move the cover relative to the base, the animal feels relatively comfortable within the device. In the meantime, the person caring for the animal is protected from the lower extremities of the animal by the base. Depending on the size of the opening, the person can also be protected from the front legs of the animal as well.

DETAILED DESCRIPTION OF THE INVENTION

Figure 1:
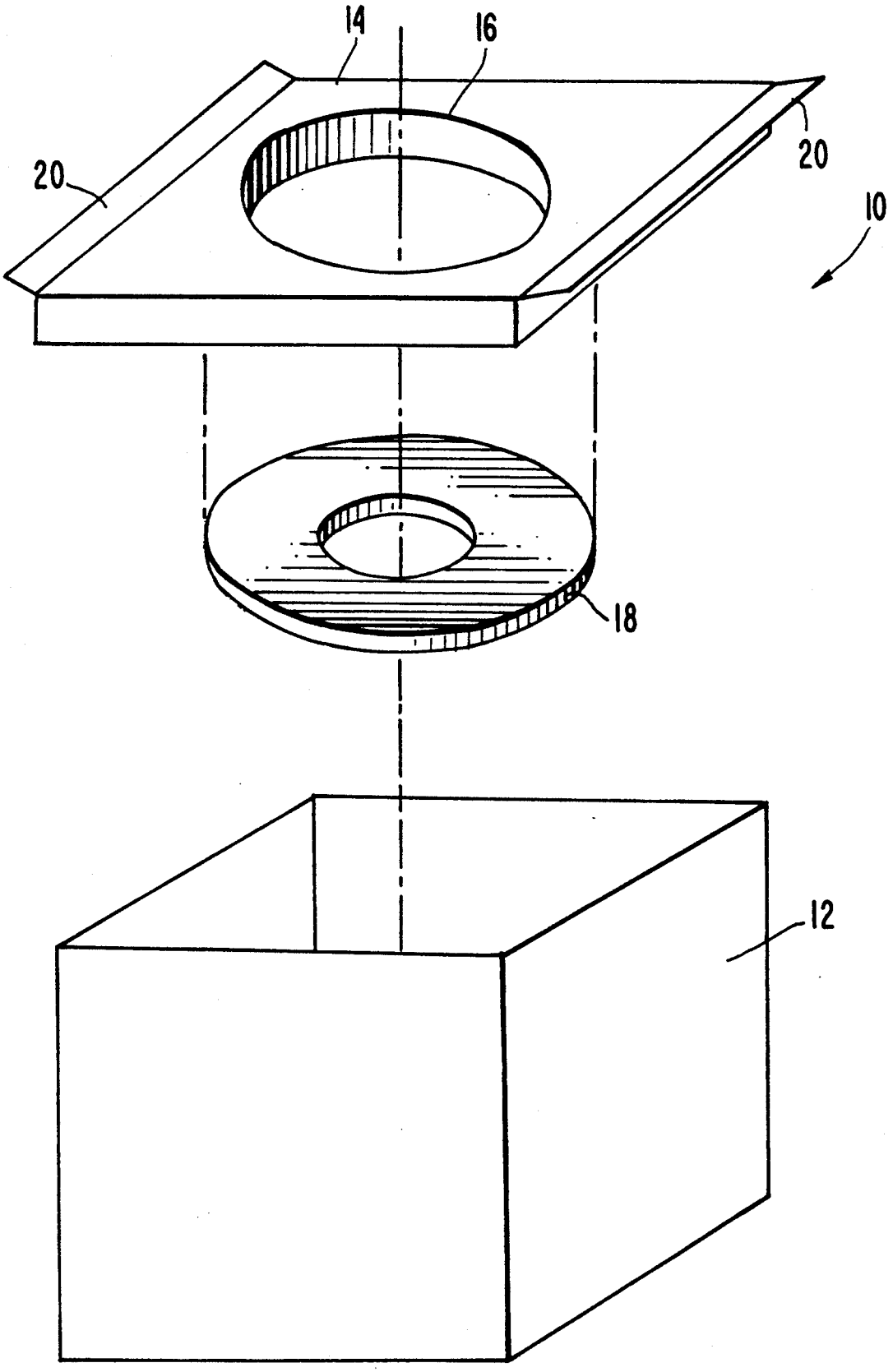
FIG. 1 is an exploded view showing a first embodiment of the present invention.

Referring to FIG. 1, a restraining device 10 is shown having a base 12 with an open bottom. A cover 14 is provided for movement within the base 12. As can be seen in FIG. 1, the cover 14 has an aperture 16. The aperture is typically designed to be large enough to permit the animal to be restrained with its head protruding from the aperture 16. If desired, the opening of the aperture 16 can be large enough to permit the forelegs to also be able to extend through the opening. As shown in FIG. 1, an adherable template 18 can be provided on the underside of the cover 14. The adherable template can be placed on the cover 14 by way of any desired adhering means, including Velcro (a registered trademark), paste, a latch pin arrangement, etc. Obviously, if different size templates 18 are provided, the restraining device can be modified to hold a variety of sizes of animals.

In operation of the restraining device 10, one can either place the animal into the base 12, or the base 12 can be placed over the animal. Following this, one simply places the cover over the animal to permit its head to protrude through the aperture 16. Of course, a suitable template 18 is used for the particular animal in question.

One important aspect of the invention is that it is preferred to have the cover 14 set within the base 12 so that it can float on top of the animal (for example, so that it can be moved by the shoulders of the animal). The animal will feel less constrained with this arrangement. The person can use his or her hands, wrists or forearms on either side of the cover while grasping the animal's head to open its jaws and insert a pill or other medicine into the mouth of the animal. In other words, the person can restrain the animal by pressing down on the cover (thereby preventing the animal from jumping out of the base) while the cover and the base simultaneously combine to protect the person from the legs of the animal. Of course, depending on the size of the opening in the cover 14, the cover can also protect the user from injury from the front legs of the animal if it is sufficiently small to prevent the front legs of the animal from extending through it.

In order to provide a frictional fit for the cover 14 within the base 12, flaps 20 can be provided along the periphery of the cover, as shown in FIG. 1. When the cover is inserted in the base, these flaps can be bent either up or down to press out against the inner side walls of the base 12 to make it more difficult for the animal to move the cover. These flaps are optional, depending whether one is especially concerned with the possibility of the animal jumping from the box. Of course, the number and location of the flaps are also optional. Generally, the flaps will make the animal feel more restricted due to the fact that they will make it more difficult for the animal to move. However, the flaps will also decrease the possibility of the animal readily leaping out of the device.

Figure 2:
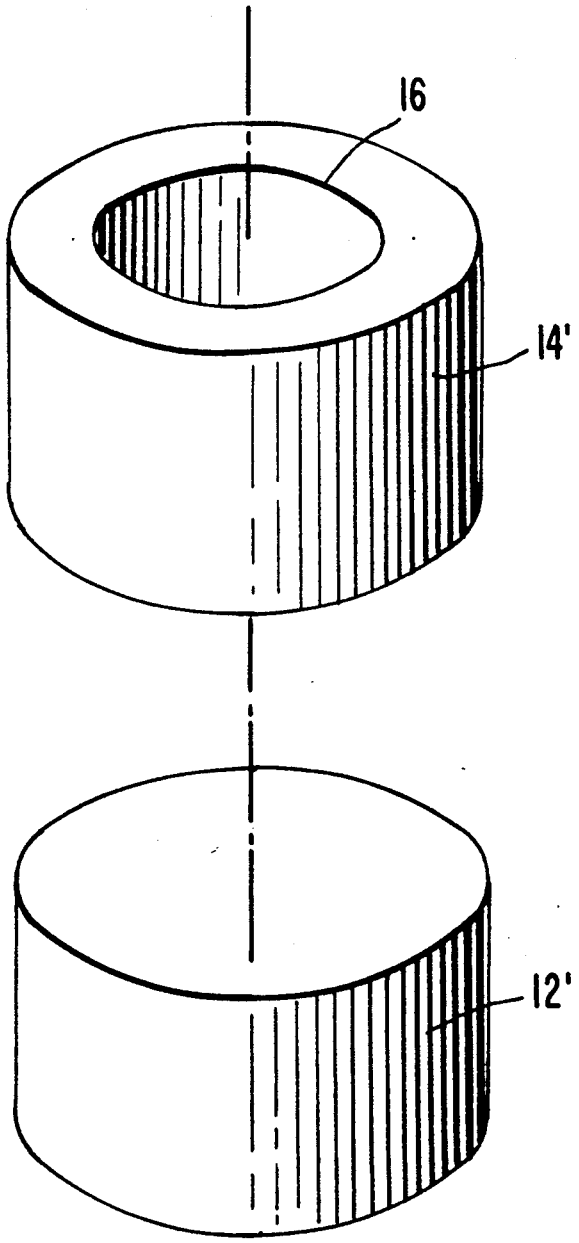
FIG. 2 is an exploded diagram showing a second embodiment of the present invention.

FIG. 2 shows a second embodiment of the present invention. In this embodiment, the cover 14' is arranged to include side walls which extend along the outer periphery of the base 12 in a telescoping manner. As such, the side walls of the cover 14' correspond in shape to the shape of the side walls of the base, with the peripheral dimensions of the side wall of the cover being just slightly larger than the peripheral dimensions of the side wall of the base. In this way, the animal in the base can still move the cover 14' up and down with its shoulders or body to give the animal a sense of relative freedom within the base. Of course, in this embodiment, the size of the opening can also be adjusted using a template such as 18 shown in the embodiment of FIG. 1. In the second embodiment, the cover 14' can be completely removed, if desired, to facilitate placing the animal in the base, especially if a bottom is provided for the base. On the other hand, if no bottom is provided for the base, the cover can be kept in place, if desired, so that the cover and the base can be placed together over the top of the animal.

As noted above, the present invention has a major advantage in being able to protect the person administering care to the animal while still giving the animal a sense of relative freedom. This is the case by virtue of the animal being able to move the cover up and down within a range determined to be permissible by the person administering the care. Of course, if desired, an upper stop arrangement could be provided (for example, a lip around the upper inner edge of the base of FIG. 1) to prevent the animal from being able to suddenly leap from the box.

Another feature of the present invention, particularly with regard to animals such as cats, is that they actually enjoy being in the restraining device. Cats, of course, are always curious about entering into the inside of boxes and the like, and apparently have a sense of security and privacy in doing this. The present invention capitalizes on this natural tendency of the animal. The enjoyment is further enhanced by the movable cover with the opening that lets the animal extend its head outside of the base to look around.

Although the invention has been described primarily with regard to cats, the restraining device is suitable for other types of animals including dogs, rabbits, chickens, etc.

Also, although the embodiments have been shown in terms of a square device or a cylindrical device, other shapes including rectangles, ovals, etc. could be used, if desired.

Also, although flaps have been shown in FIG. 1 for increasing friction, other means could be used. For example, in the embodiment of FIG. 2, the inside surface of the cover and the outside surface of the base could be roughened to create friction between these two elements. Incidentally, with regard to embodiment 2, if a bottom is provided for the base, and if a latch arrangement is provided to lock the cover to the base, the restraining device 10 can double as a transporting device for the animal. In conjunction with this, the template 18 can be replaced, if desired, by a template with a plurality of small air openings rather than a single large opening for the animal's head.

Although the foregoing description has related to a template 18 which is adhered to the bottom of the cover 14, it can, if desired, be secured to the top of the cover by fastening means sufficient to hold it to the cover when the animal moves. This would have the advantage of being able to change the opening size without having to remove the cover 14.

The restraining device 10 can be manufactured from a variety of materials. For minimizing cost, cardboard of sufficient strength would be suitable. On the other hand, for durability and strength, stronger materials including stiff plastics, metal, etc. could be used if desired.

It is to be understood that the above-identified arrangements are simply illustrative of the application of the principles of this invention. Numerous other arrangements may be readily devised by those skilled in the art which embody the principles of the invention and fall within its spirit and scope.

I claim:

1. An animal restraining device for permitting a human to safely attend to caring for an animal comprising:

a base having a peripheral side wall for surrounding said animal;

a cover having an opening for the animal's head, wherein said cover is to be placed over the animal's head and is capable of movement relative to the base so that said animal is comfortably restrained within the base to be able to move the cover within a predetermined range relative to the base while the human is safely protected from injury from the lower or rear extremities of the animal;

wherein said cover comprises a substantially flat plate-like member arranged to fit within the inside of the base to be moved up and down in the base on the shoulders of the animal; and wherein said cover includes flaps extending at the peripheral edge of the cover into contact with an inner side wall of the base to create a frictional fit between the cover and the base.

2. An animal restraining device according to claim 1, further comprising a template which is adhered to the cover for decreasing the size of the opening for the animal's head.

3. An animal restraining device according to claim 1, wherein the base does not include a bottom so that the base can be placed over the top of the animal.

4. An animal restraining device according to claim 1, wherein said base includes a bottom portion.

5. An animal restraining device according to claim 1, wherein the base has four sides forming the peripheral side wall so that the base comprises a rectangular shape when viewed from above.

6. An animal restraining device according to claim 5, wherein said four sides are of equal length so that said base is square when viewed from above.

7. An animal restraining device according to claim 1, wherein said peripheral side wall of said base forms a cylindrical side wall.

8. An animal restraining device according to claim 1, wherein the cover has at least four sides, and wherein at least one of said flaps is provided at predetermined ones of said sides to create said frictional fit.

9. An animal restraining device according to claim 8, wherein the cover has four sides, and wherein at least one of said flaps is provided at a predetermined one of said four sides, and wherein at least one of said flaps is provided at one of said four sides which is opposite to said predetermined one of said four sides.

* * * * *